United States Patent [19]

Roof et al.

[11] Patent Number: 4,919,285

[45] Date of Patent: Apr. 24, 1990

[54] TAMPER EVIDENT CLOSURE AND METHOD OF MANUFACTURE OF THE SAME

[75] Inventors: William M. Roof; Eric J. Roberts, both of Louisville; Dennis P. Blair, Prospect, all of Ky.

[73] Assignee: Thoroughbred Plastics Corp., Louisville, Ky.

[21] Appl. No.: 192,564

[22] Filed: May 11, 1988

[51] Int. Cl.[5] ..... B65D 41/34

[52] U.S. Cl. ..... 215/230; 215/252; 156/73.1; 156/242; 29/527.1

[58] Field of Search ..... 215/252, 230; 156/73.1, 156/242; 29/527.1

[56] References Cited

U.S. PATENT DOCUMENTS

| | | | |
|---|---|---|---|
| 4,493,427 | 1/1985 | Wolkonsky | 215/252 X |
| 4,643,321 | 2/1987 | Gach | 215/252 |
| 4,700,859 | 10/1987 | Gregory | 215/252 |

FOREIGN PATENT DOCUMENTS

| | | | |
|---|---|---|---|
| 2518117 | 11/1976 | Fed. Rep. of Germany | 215/252 |

*Primary Examiner*—Donald F. Norton

*Attorney, Agent, or Firm*—Kline, Rommel & Colbert

[57] ABSTRACT

A tamper evident closure for use on a container neck, the closure including a cap and separately formed security device, connector means for attachment of the security device to the cap, the security device including anchor means disposed to catch beneath a shoulder as provided on the container neck when the cap is attached to the container neck, the connector means comprising a frangible joint adapted to rupture during removal of the cap from the container neck whereby to enable the security device to break away from the cap, the anchor means being engageable with the shoulder of the container for retaining the security device on the container neck when the cap is removed therefrom, the security device thereby evidencing that the container has been opened; and a method of manufacturing such tamper evident closure.

42 Claims, 2 Drawing Sheets

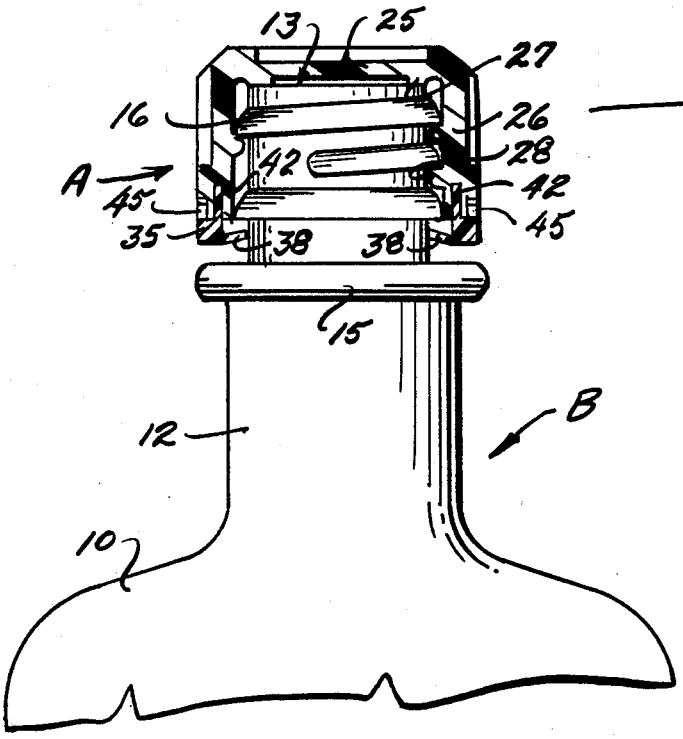
Fig. 7.
Fig. 9.
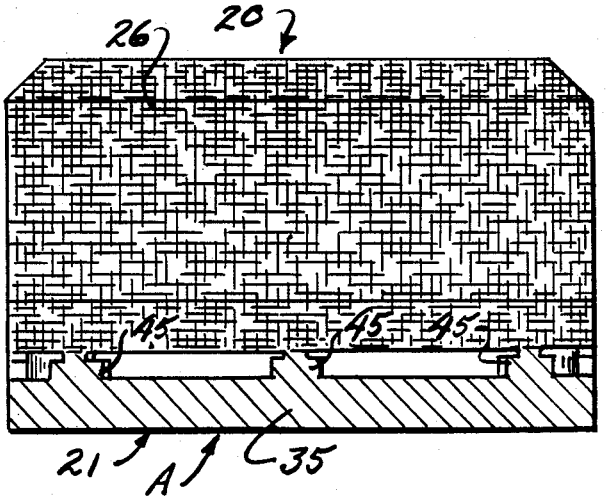
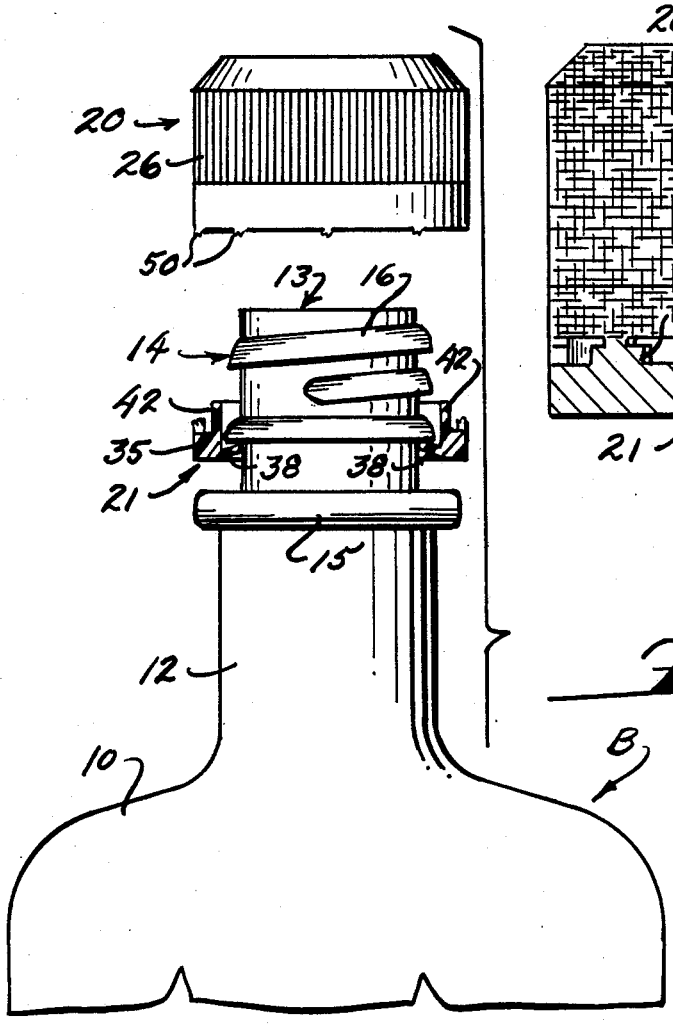
Fig. 8.

TAMPER EVIDENT CLOSURE AND METHOD OF MANUFACTURE OF THE SAME

BRIEF BACKGROUND, FIELD AND OBJECTIVES OF THE INVENTION

This invention relates to improvements in tamper evident closures and the method of manufacture of the same.

We are aware that others have previously provided tamper evident closures including a cap and a security ring and in which the cap breaks away from the security ring on removal of the cap from the container, the security ring remaining on the container and evidencing that the container has been opened. In all such devices of which we are aware, for instance, as shown in U.S. Pat. Nos. 3,329,295; 4,196,818; 4,322,009; 4,401,227; and 4,506,795, the cap and security device are molded as an integral one piece unit. In view of the criticality of certain dimensions of tamper evident closures of this type, particularly in the formation of the frangible links by way of which the cap is molded to the security ring, their manufacture calls for the use of complex molds, an involved cutting operation, or both.

The cap and security ring of earlier tamper evident closures are molded in one piece, the entirety of which is of the same material and of the same color. Also, in devices of this type, the side walls thereof have a plurality of openings extending therethrough, to the sides of which are provided the links which connect the cap to the security ring. Thus, these devices are particularly vulnerable to side shear and separation of the cap from the security ring during the hoppering and sorting phases of the capping operation.

It is a primary object of this invention to provide a tamper evident closure in which the cap is formed independently and separately from the security ring thereof, the cap and security ring thereafter being interconnected by a plurality of spaced apart fused bridges which comprise frangible zones of weakness adapted to rupture during removal of the cap from the container.

A further object is the provision of a tamper evident closure in which the cap thereof may be formed of a material different from that of the security ring thereof. Thus, for instance, the cap can be formed of relatively rigid material, in order to withstand higher application torques and to preclude overstripping on the bottle finish, and the security ring can be formed of more flexible material to facilitate the application thereof over the security ring retaining shoulder of the container neck during attachment of the closure to the container neck.

Another object of the invention is the provision of a tamper evident closure in which the cap may be molded of a different color from the security ring. This will enable use of color coding for such as designating the contents of variously color-coded containers as being of different strengths, mixtures, etc. The use of two different colors provides a much wider selection than would be possible if only one color were available, i.e., the cap and security ring being of the same color. Also, molding in a color provides a permanent color coding that will not rub off or otherwise be removed from the cap and security ring.

A still further object of this invention is the provision of a method of manufacture of a tamper evident closure in which the cap is molded separately and independently from the security ring thereof and for the assemblage and interconnection together of cap and security ring to provide a unitary tamper evident closure.

A continuing problem has been to provide a tamper evident closure in which the links between the cap and security ring thereof are such as to enable the cap to break cleanly away from the security ring on removal of the cap from the container neck and yet are sufficiently strong to prevent separation of the cap from its security ring during the hoppering, sorting and attaching phases of the capping operation. Due to the inherent problems of flow and distribution, it has proven difficult to mold an area of appropriate frangibility into the links that extend between a cap and its security ring and, since it is rare that mass production techniques will produce a perfectly cylindrical closure, weakening of the links by cutting away a portion thereof is imperfect, at best, some cuts being too deep, while others are not deep enough.

It is thus a still further object of this invention to provide a method of manufacture of tamper evident closures in which the areas of frangibility of the interconnections between the cap and security ring thereof are formed as a feature of interconnection and can thus be carefully crafted to provide appropriate zones of weakness which are of sufficient strength to withstand the hoppering, sorting and attaching operations, but will break cleanly on removal of the cap from a container neck.

Other objects and advantages of the invention will become apparent from the following detailed description, taken in connection with the accompanying drawings, and in which drawings:

FIG. 7 is a view, partly in section, showing our improved tamper evident closure as attached to the neck of a container.

FIG. 8 is a view similar to FIG. 7, but showing the cap of our improved closure removed from the neck of a container, the security ring thereof remaining on the container neck and thereby evidencing that the container has been opened.

FIG. 9 is a side view of our improved tamper evident closure and which illustrates color coding in which the cap thereof is molded of a color different from that of the security ring.

DETAILED DESCRIPTION

Figure 1:
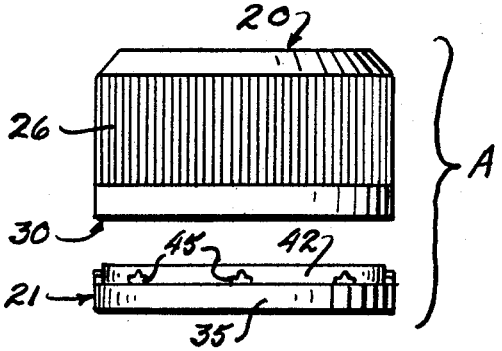
FIG. 1 is a side view of the cap and security ring of our improved closure as independently and separately molded and prior to interconnection together.
Figure 2:
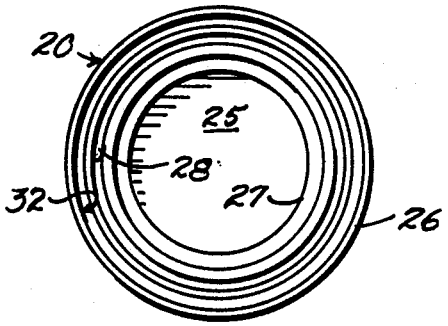
FIG. 2 is a bottom plan view of the cap of our improved closure.

In the drawings, wherein is shown a preferred embodiment of our invention, and wherein similar reference characters designate corresponding parts throughout the several view, the letter A may generally designate our improved tamper evident closure as provided for attachment to such as a container B.

As shown, container B may comprise a container 10 which includes a container neck 12 having a mouth 13 and a cap retaining means 14 and including a shoulder 15 disposed below the cap retaining means thereof. In the form as shown in the drawings, cap retaining mean 14 comprises an external screw thread portion 16 as provided on container neck 12, and shoulder 15 comprises an annular ring as provided about container neck 12 below screw thread portion 16 thereof.

Tamper evident closure A preferably includes a cap 20 and a security device 21, both of which may be comprised of a molded thermoplastic resin such as polypropylene. Also, as clearly illustrated in FIG. 1, cap 20 is preferably molded independently of and as a separate element from security device 21. In this regard, cap 20 is preferably molded of a material having sufficient rigidity to withstand the higher application torques encountered on attachment of the cap to container neck 12 and to preclude stripping of the bottle finish.

Cap 20 may include a top portion 25 having a depending cylindrical skirt 26.

The inner surface of top portion 25 may be provided with a sealing ring 27, which may be of the type as shown in U.S. Pat. No. 4,360,114, and which is configured to be engaged about mouth 13 of container neck 12. As thus configured, cap 20 comprises a linerless cap.

Cylindrical skirt 26 may be provided with an internal screw thread portion 28 for mating with external screw thread portion 16 of container neck 12 and which comprises retaining means cooperating with retaining means 14 of container neck 12 whereby to retain cap 20 on container neck 12.

It is apparent that cap 20 may be configured as one which receives a liner for sealing attachment thereof to a bottle, rather than as a linerless closure, and that the respective retaining means of the cap and bottle may be other than by way of threaded interengagement. Also, that cap 20 may include other structural features, as desired, such as those for providing a child-resistant cap, etc., and may be formed in such size as is appropriate.

Cylindrical skirt 26 has a lower edge portion 30, about which may be provided a cylindrical groove 32 as inset from the outer periphery thereof, that part of the lower edge portion 30 as provided between the outer periphery of skirt 26 and groove 32 comprising a land surface 33, for purposes as will be subsequently described.

Security device 21 is preferably comprised to the nature of a security ring or annular band 35 configured to extend circumferentially about container neck 12 and is provided with anchor means 36 which may comprise a plurality of spaced apart fingers 38 extending inwardly thereof and disposed to pass over and catch beneath shoulder 15 when cap 20 is juxtaposed on container neck 12 for closing mouth 13 thereof.

Security device 21 may be of a material having less rigidity than that of cap 20 whereby fingers 38 may flex to pass over shoulder 15 of container neck 12 when closure A is applied onto container neck 12 and yet are sufficiently rigid to hold security device on container neck 12 below shoulder 15 thereof on removal of cap 20 from container neck 12 and separation of cap 20 from security device 21.

Of course, cap 20 and security device 21 may be optionally comprised of the same material, the composition thereof being selected as desired. Also, the number and disposition of fingers 38 may be varied, as desired.

Figure 3:
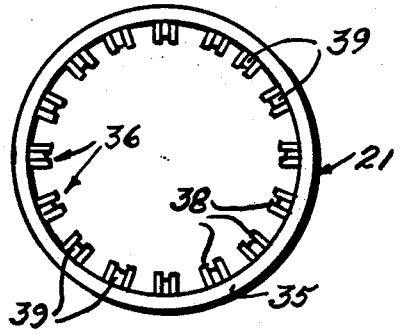
FIG. 3 is a bottom plan view of the security ring of our improved closure.
Figure 4:
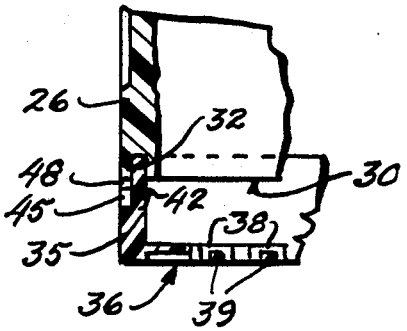
FIG. 4 is an enlarged fragmentary view showing the cap and security ring of our improved closure as disposed in juxtaposition to each other for attachment together.
Figure 5:
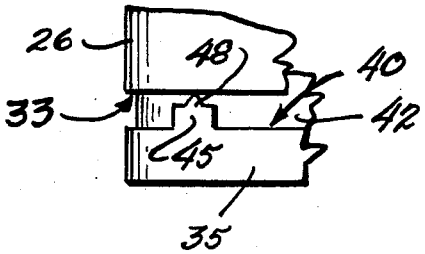
FIG. 5 is a fragmentary side view showing the cap and security ring as disposed in the relation to each other which is shown in FIG. 4.

As shown in FIG. 3, the molding of fingers 38 may be such that each has a channel 39 extending therealong. Such configuration facilitates molding of fingers 38, particularly by way of filling the mold so that fingers 38 are fully formed.

Security ring 35 has an upper edge portion 40 that may include an upwardly extending cylindrical tongue 42 which comprises a male guide means adapted to mate with the female guide means of cap 20, providing a tongue and groove fit of tongue 42 of security ring 35 as received within groove 32 of cap 20.

It is not necessary that either groove 32 or tongue 42 extend continuously about the member of which they are apart. Each may be abbreviated, but they are preferably coextensive to a sufficient extent such as to minimize the likelihood of side shear and separation of cap 20 from security device 21 during the hoppering and sorting phases of the capping operation.

Cylindrical tongue 42 is preferably inset from the outer periphery of security ring 35, that part of upper edge portion 40 as provided between the outer periphery of security ring 35 and cylindrical tongue 42 thereof comprising a land surface 44.

Land surface 44 of security ring 35 may be provided with a plurality of spaced apart platforms or protuberances 45 which extend upwardly therefrom and are disposed about the periphery of cylindrical tongue 42 and comprise connector means for attachment of security ring 35 to cap 20.

Protuberances 45 are each preferably provided with a tapered tip 48 and are configured such that when cap 20 and security ring 35 are interfitted together with cylindrical tongue 42 of security ring 35 received in a tongue and groove fit within groove 32 of cap 20, the tapered tip 48 of each protuberance 45 abuts against the confronting land surface 33 of the lower edge portion 30 of cap 20.

In attachment of cap 20 to security ring 35, they are preferably lightly held together in juxtaposed relation with tongue 42 of security ring 35 interfitted within groove 32 of cap 20 and the tapered tips 48 of protuberances 45 abutting against a confronting land surface 33 of cap 30. Protuberances 45 are then fused or otherwise attached to the land surface 33 confronting the same, providing a fused bridge means for interconnecting cap 20 to security ring 35.

Figure 6:
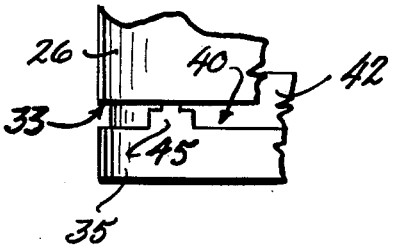
FIG. 6 is a fragmentary side view showing the cap and security ring of our improved closure as fused together.

We preferably utilize an ultrasonic welding technique for fusing protuberances 45 to land surface 33. We have found that ultrasonic welding can be appropriately carried out such that fusing of protuberances 45 to land surface 33 extends for only a predetermined distance of each tapered tip 48, as most clearly shown in FIG. 6, whereby we can regulate the area of fusion thereof and thereby provide a joint means having an optimum frangible zone of weakness such as to rupture during removal of cap 20 from container neck 12, whereby to enable cap 20 to break away from security ring 35, fingers 38 engaging against shoulder 15 of container neck 12 and thereby retaining security ring 35 on container neck 12 when cap 20 is removed therefrom.

A closure in which the security ring 35 thereof is separated from its cap 20 evidences that the container has been opened. As shown in FIG. 8, rupture of the fused bridge means of the closure will usually leave stubs 50 extending from skirt 26, so even if security ring 35 is subsequently removed from container neck 12, stubs 50, which will almost always have rough and uneven lower edges at the area of rupture thereof, will clearly evidence that the container has been opened.

Of course, cap 20 may be configured such that cap 20 may be fused, welded or otherwise attached to security device 21 in a manner other than as herein shown and described. For instance, the lower edge 30 of skirt 26 may comprise a male guide means including cylindrical tongue 42, the upper edge 40 of security ring 35 may comprise a female guide means including a groove 32, and protuberances 45 may be provided as extending from land surface 33 of cap 20.

It is also apparent that protuberances 45 may be configured other than as having a tapered tip 48, may be disposed other than circumferentially about cylindrical tongue 42, for instance about the inner diameter thereof, or otherwise, as desired, and may be fused or otherwise appropriately attached as bridge means comprising frangible zones of weakness adapted to rupture during removal of cap 20 from container neck 12.

Since, as previously described, cap 20 may be molded independently of and as a separate element from security device 21, then, as shown in FIG. 9, cap 20 may be molded of material which is of a different color from the material of which security device 21 is molded. By way of example, cap 20 being comprised of a material which is gold in color and security device 21 being comprised of a material which is green in color.

Various changes may be made to the form of the invention herein shown and described without departing from the spirit of the invention or the scope of the following claims:

We claim:

1. A tamper evident closure for use on a container having a neck provided with a mouth, cap retaining means and including a shoulder disposed below the cap retaining means thereof, said closure comprising a cap, a security ring formed disjunctively from said cap, and fused bridge means for interconnecting said security ring to said cap, said cap including retaining means adapted to cooperate with the cap retaining means of the container neck thereby to retain said cap on the container neck as juxtaposed for closing the mouth thereof, said security ring including anchor means disposed to pass over and catch beneath the shoulder of the container when said cap is juxtaposed on the container neck for closing the mouth thereof, and said fused bridge means comprise frangible zones of weakness adapted to rupture during removal of said cap from said container neck whereby to enable said security ring to break away from said cap, said anchor means being engageable with the shoulder of the container neck for retaining said security ring on the container neck when said cap is removed therefrom.

2. A tamper evident closure as specified in claim 1 wherein said cap includes a depending cylindrical skirt having a lower edge portion and said security ring has an upper edge portion, each said edge portion having guide means inset from the outer periphery thereof, one said guide means comprising female guide means, and the other said guide means comprising male guide means disposed to mate within said female guide means, that part of each said edge portion as inset from the periphery to said guide means thereof comprising a land surface, the land surface of one said edge portion including a plurality of spaced apart protuberances extending therefrom and having a top juxtaposed to abut against the land surface of the other said edge portion, the tops of said protuberances extending from the land surface of one said edge portion being fused to the land surface of the other said edge portion against which the same abut and thereby comprising said fused bridge means.

3. A tamper evident closure as specified in claim 2 and wherein said female guide means comprises a substantially cylindrical groove and said male guide means comprises a substantially cylindrical tongue.

4. A tamper evident closure as specified in claim 3 wherein said groove extends about said lower edge portion of said skirt of said cap, said tongue extends upwardly from said upper edge portion of said security ring, and said protuberances comprise bridge means extending upwardly from said security ring and about said cylindrical tongue thereof.

5. A tamper evident closure as specified in either of claims 1, 2, 3, or 4, and wherein said cap is of one color and said security ring is of another color.

6. A tamper evident closure as specified in claim 5 and wherein said cap is molded from a given material and said security ring is molded from another material.

7. A tamper evident closure as specified in claim 6 and wherein said cap is molded from a material having a greater rigidity than the material from which said security ring is molded.

8. A tamper evident closure as specified in either of claims 1, 2, 3, or 4, and wherein said cap is molded from a given material and said security ring is molded from another material.

9. A tamper evident closure as specified in claim 8 and wherein said cap is molded from a material having a greater rigidity than the material from which said security ring is molded.

10. A tamper evident closure as specified in either of claims 2, 3, or 4, wherein said cap and said security ring are comprised of molded thermoplastic, the top of each of said protuberances comprises a tapered tip, and each said tapered tip is welded to said land surface against which said protuberances abut.

11. A tamper evident closure as specified in claim 10 and wherein each weld thereof comprises an ultrasonic weld.

12. A tamper evident closure as specified in claim 10 and wherein said cap is molded of a thermoplastic of one color and said security ring is molded of a thermoplastic of another color.

13. A tamper evident closure as specified in claim 12 and wherein each weld thereof comprises an ultrasonic weld.

14. A tamper evident closure for use on a container neck provided with a mouth and retaining means and having a shoulder disposed below the retaining means thereof, said closure including a molded cap and a molded security device as formed independently of and separate from said cap, connector means for attachment of said security device to said cap, said cap including retaining means adapted to cooperate with the retaining means of the container neck whereby to retain said cap on the container neck as juxtaposed for closing the mouth thereof, said security device having a body portion extending circumferentially about said container neck and including anchor means disposed to catch beneath the shoulder of the container neck when said cap is juxtaposed on the container neck for closing the mouth thereof, said connector means comprising frangible joint means adapted to rupture during removal of said cap from said container neck whereby to enable said security device to break away from said cap, said anchor means being engageable with the shoulder of the container neck for retaining said security device on the container neck when said cap is removed therefrom.

15. A tamper evident closure as specified in claim 14 wherein the retaining means of said container neck comprises an external screw thread portion and said retaining means of said cap comprises an internal screw thread portion adapted to mate with the external screw thread portion of the container neck, said security device comprises an annular band for encircling the neck of the container, and said anchor means comprises a plurality of spaced apart fingers disposed to pass over and catch beneath the shoulder of the container, and wherein said cap includes a cylindrical skirt portion having a substantially cylindrical groove extending about the lower edge thereof and said annular band includes a substantially cylindrical tongue extending about the upper edge thereof, hereby to provide a tongue and groove fit between said cap and said annular ring in juxtaposed relation to prevent side shear of said cap from said annular ring during the hoppering and sorting phase of the operation during which the closure is applied to the container.

16. A tamper evident closure as specified in claim 15 and wherein said connector means comprise a plurality of spaced apart bridge means extending upwardly from said annular ring and circumferentially of said tongue thereof and including a tapered tip, each said tapered tips being fused to the lower edge of said skirt of said cap and circumferentially of said groove thereof.

17. A tamper evident closure as specified in claim 16 and wherein said cap and said annular ring are comprised of thermoplastic material and each said bridge means is welded to said skirt by an ultrasonic weld.

18. A tamper evident closure as specified in either of claims 14, 15, 16, or 17, and wherein said cap is molded of one material and said security device is molded of another material.

19. A tamper evident closure as specified in claim 18 and wherein said cap is molded of material of one color and said security device is molded of material of another color.

20. A tamper evident closure as specified in claim 19 and wherein said cap is molded of a material having greater a rigidity than the material of which said security device is molded.

21. A tamper evident closure as specified in either of claims 14, 15, 16, or 17, and wherein said cap is molded of material of one color and said security device is molded of material of another color.

22. A method of manufacturing a tamper evident closure for use on a container neck provided with a mouth and having a shoulder disposed below the mouth thereof, and wherein the tamper evident closure includes a cap configured to serve as a closure for the mouth of the container and a security device detachably interconnected thereto, the security device being provided with anchor means adapted to catch beneath the shoulder of the container neck for retaining the security device on the container neck when the cap is unloosened and removed from the container neck, the method comprising the steps of molding the cap, molding the security device independently of and separate from the cap, and interconnecting the cap and security device by connector means adapted to rupture during removal of the cap from the container neck whereby to enable the security device to break away from the cap and remain on the container neck when the cap is removed therefrom.

23. A method of manufacturing a tamper evident closure as specified in claim 22 and which is for use on a container neck having an external screw thread portion and the shoulder of the container neck is disposed below the screw thread portion thereof, and wherein the cap is molded with a depending skirt portion having an internal screw thread portion for mating with the external screw thread portion of the container neck, and the security device is molded as an annular ring for extending about the container neck and is provided with a plurality of spaced apart fingers which comprise the anchor means thereof, the skirt portion of the cap is molded with a groove extending about the lower edge portion thereof and the security device is molded with a tongue extending upwardly from the upper edge thereof in juxtaposition for a tongue and groove fit within the groove of the skirt of the cap, and wherein the assemblage of a cap to an annular ring includes the steps of mating one to the other by a tongue and groove fit as provided by insertion of the tongue of the annular ring to within the groove of the skirt of the cap and thence interconnecting the cap to the skirt by the connector means.

24. A method of manufacture as specified in either of claims 22, or 23, and wherein the cap is molded of one material and the security device is molded of another material.

25. A method of manufacture as specified in claim 24 and wherein the cap is molded of material of one color and the security device is molded of material of another color.

26. A method of manufacture as specified in claim 24 and wherein the cap is molded of a material having a greater rigidity than the material of which the security device is molded.

27. A method of manufacture as specified in claim 26 wherein the cap is molded of material of one color and the security device is molded of material of another color.

28. A method of manufacture as specified in either of claims 22, or 23, and wherein the cap is molded of material of one color and the security device is molded of material of another color.

29. A method of manufacture as specified in either of claims 22, or 23, and wherein the cap and the security device are molded of thermoplastic material and the connector means are comprised of a plurality of spaced apart bridges which are molded as a part of the security device and are fused to the cap.

30. A method of manufacture as specified in claim 29 and wherein the bridges are fused to the security device by an ultrasonic weld.

31. A method of manufacture as specified in claim 30 and wherein the cap is molded of one material and the security device is molded of another material.

32. A method of manufacture as specified in claim 31 and wherein the cap is molded of material of one color and the security device is molded of material of another color.

33. A method of manufacture as specified in claim 31 and wherein the cap is molded of a material having a greater rigidity than the material of which the security device is molded.

34. A method of manufacture as specified in claim 33 wherein the cap is molded of material of one color and the security device is molded of material of another color.

35. A method of manufacture as specified in claim 29 and wherein the cap is molded of material of one color and the security device is molded of material of another color.

36. A method of manufacture as specified in claim 29 and wherein the cap is molded of one material and the security device is molded of another material.

37. A method of manufacture as specified in claim 36 and wherein the cap is molded of a material having a greater rigidity than the material of which the security device is molded.

38. A method of manufacture as specified in claim 37 and wherein the cap is molded of one color and the security device is molded of another color.

39. A method of manufacture as specified in claim 35 and wherein the bridges are fused to the security device by an ultrasonic weld.

40. A tamper evident closure for use on a container having a neck provided with a mouth, cap retaining means and including a shoulder disposed below the cap retaining means thereof, said closure comprising a cap and a security ring formed disjunctively from said cap, and means for interconnecting said security ring to said cap, said cap including retaining means adapted to cooperate with the cap retaining means of the container neck whereby to retain said cap on the container neck as juxtaposed for closing the mouth thereof and a depending cylindrical skirt having a lower edge portion, said security ring including anchor means disposed to pass over and catch beneath the shoulder of the container when said cap is juxtaposed on the container neck for closing the mouth thereof and an upper edge portion, each said edge portion having guide means inset from the outer periphery thereof, one said guide means comprising female guide means, and the other said guide means comprising male guide means disposed to mate within said female guide means in juxtarelation to minimize side shear and separation of said security ring front said cap during assembly of one to the other, said means for interconnecting said security ring to said cap comprising zones of weakness adapted to rupture during removal of said cap from said container neck cap, said anchor means being engageable with the shoulder of the container neck for retaining said security ring on the container neck when said cap is removed therefrom.

41. A tamper evident closure as specified in claim 40 and herein said female guide means comprises a substantially cylindrical groove and said male guide means comprises a substantially cylindrical tongue.

42. A tamper evident closure as specified in claim 41 wherein said groove extends about said lower edge portion of said skirt of said cap, said tongue extends upwardly from said upper edge portion of said security ring, and protuberances comprising bridge means extend upwardly from said security ring and about said cylindrical tongue thereof.

* * * * *

UNITED STATES PATENT AND TRADEMARK OFFICE

CERTIFICATE OF CORRECTION

PATENT NO. : 4,919,285

DATED : 04/24/90

INVENTOR(S) : Roof, William M.; Roberts, Eric J.; Blair, Dennis P.

It is certified that error appears in the above-identified patent and that said Letters Patent is hereby corrected as shown below:

The title page showing the issustrative figure should be deleted to be replaced with the attached title page.

Signed and Sealed this

Twenty-first Day of April, 1992

*Attest:*

HARRY F. MANBECK, JR.

*Attesting Officer*

*Commissioner of Patents and Trademarks*

United States Patent [19]

Roof et al.

[11] Patent Number: 4,919,285

[45] Date of Patent: Apr. 24, 1990

[54] TAMPER EVIDENT CLOSURE AND METHOD OF MANUFACTURE OF THE SAME

[75] Inventors: William M. Roof; Eric J. Roberts, both of Louisville; Dennis P. Blair, Prospect, all of Ky.

[73] Assignee: Thoroughbred Plastics Corp., Louisville, Ky.

[21] Appl. No.: 192,564

[22] Filed: May 11, 1988

[51] Int. Cl.[5] ..... B65D 41/34

[52] U.S. Cl. ..... 215/230; 215/252; 156/73.1; 156/242; 29/527.1

[58] Field of Search ..... 215/252, 230; 156/73.1, 156/242; 29/527.1

[56] References Cited

U.S. PATENT DOCUMENTS 4,493,427 1/1985 Wolkonsky ..... 215/252 X
4,643,321 2/1987 Gach ..... 215/252
4,700,859 10/1987 Gregory ..... 215/252

FOREIGN PATENT DOCUMENTS 2518117 11/1976 Fed. Rep. of Germany ..... 215/252

*Primary Examiner*—Donald F. Norton
*Attorney, Agent, or Firm*—Kline, Rommel & Colbert

[57] ABSTRACT

A tamper evident closure for use on a container neck, the closure including a cap and separately formed security device, connector means for attachment of the security device to the cap, the security device including anchor means disposed to catch beneath a shoulder as provided on the container neck when the cap is attached to the container neck, the connector means comprising a frangible joint adapted to rupture during removal of the cap from the container neck whereby to enable the security device to break away from the cap, the anchor means being engageable with the shoulder of the container for retaining the security device on the container neck when the cap is removed therefrom, the security device thereby evidencing that the container has been opened; and a method of manufacturing such tamper evident closure.

42 Claims, 2 Drawing Sheets

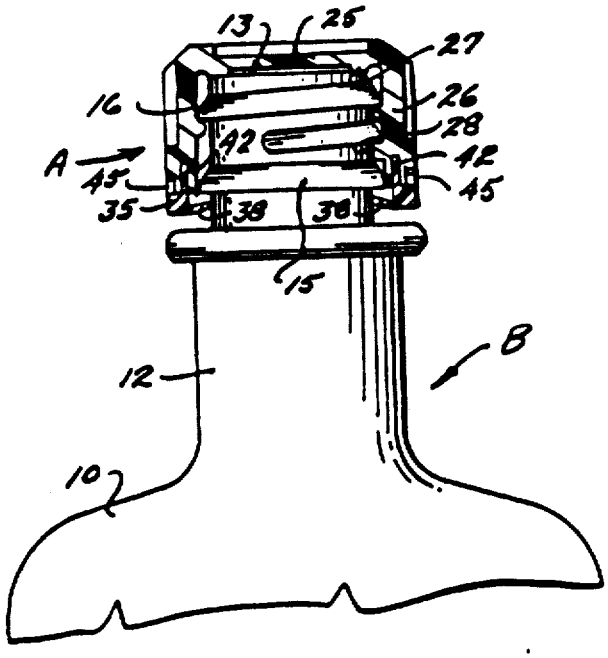

UNITED STATES PATENT AND TRADEMARK OFFICE

CERTIFICATE OF CORRECTION

PATENT NO. : 4,919,285

DATED : 04/24/90

INVENTOR(S) : Roof, William M.; Roberts, Eric J.; Blair, Dennis P.

It is certified that error appears in the above-identified patent and that said Letters Patent is hereby corrected as shown below:

In the drawings, Sheet 1, Fig. 1, the reference character 44 and lead line should be applied to appear as follows:

Fig. 1.

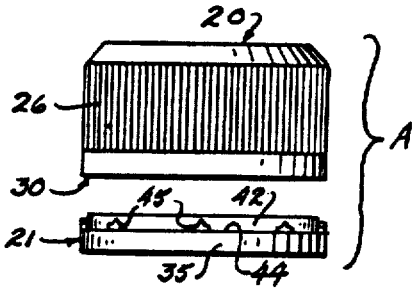

In the drawings, Sheet 2, Fig. 8, the lead line for reference character 15 should be extended to appear as follows:

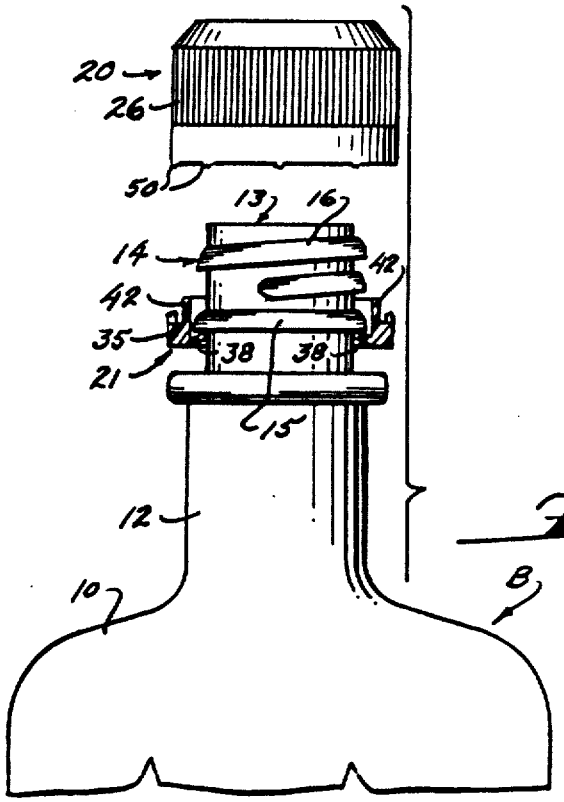

Fig. 8.

UNITED STATES PATENT AND TRADEMARK OFFICE

CERTIFICATE OF CORRECTION

PATENT NO. : 4,919,285

DATED : 04/24/90

INVENTOR(S) : Roof, William M.; Roberts, Eric J.; Blair, Dennis P.

It is certified that error appears in the above-identified patent and that said Letters Patent is hereby corrected as shown below:

In the drawings, Sheet 2, Fig. 7, extend the lead line for reference character 15 to appear as follows:

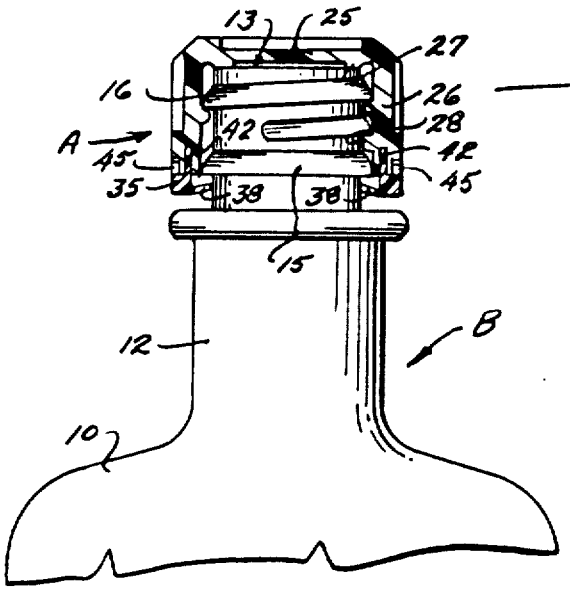

Fig. 7.

REEXAMINATION CERTIFICATE (1542nd)

United States Patent [19] [11] B1 4,919,285

Roof et al. [45] Certificate Issued Aug. 27, 1991

[54] TAMPER EVIDENT CLOSURE AND METHOD OF MANUFACTURE OF THE SAME

[75] Inventors: William M. Roof; Eric J. Roberts, both of Louisville; Dennis P. Blair, Prospect, all of Ky.

[73] Assignee: Thoroughbred Plastics Corp., Louisville, Ky.

Reexamination Request:
No. 90/002,168, Oct. 16, 1990

Reexamination Certificate for:

| | |
|---|---|
| Patent No.: | **4,919,285** |
| Issued: | **Apr. 24, 1990** |
| Appl. No.: | **192,564** |
| Filed: | **May 11, 1988** |

Certificate of Correction issued Apr. 24, 1990.

[51] Int. Cl.[5] ..... B65D 41/34
[52] U.S. Cl. ..... 215/230; 215/252; 156/73.1; 156/242; 29/527.1
[58] Field of Search ..... 215/230, 252, 258

[56] References Cited

U.S. PATENT DOCUMENTS

| | | | |
|---|---|---|---|
| 4,493,427 | 1/1985 | Wolkonsky | 215/230 |
| 4,511,053 | 4/1985 | Brandes et al. | 215/252 |
| 4,643,321 | 2/1987 | Gach | 215/252 |
| 4,679,696 | 7/1987 | Bonnenfant et al. | 215/252 |
| 4,700,859 | 10/1987 | Gregory | 215/252 |

FOREIGN PATENT DOCUMENTS

| | | |
|---|---|---|
| 0273858 | 7/1988 | European Pat. Off. . |
| 2518117 | 11/1976 | Fed. Rep. of Germany . |
| 722601 | 1/1976 | France . |

*Primary Examiner*—Stephen Marcus

[57] ABSTRACT

A tamper evident closure for use on a container neck, the closure including a cap and separately formed security device, connector means for attachment of the security device to the cap, the security device including anchor means disposed to catch beneath a shoulder as provided on the container neck when the cap is attached to the container neck, the connector means comprising a frangible joint adapted to rupture during removal of the cap from the container neck whereby to enable the security device to break away from the cap, the anchor means being engageable with the shoulder of the container for retaining the security device on the container neck when the cap is removed therefrom, the security device thereby evidencing that the container has been opened, and a method of manufacturing such tamper evident closure.

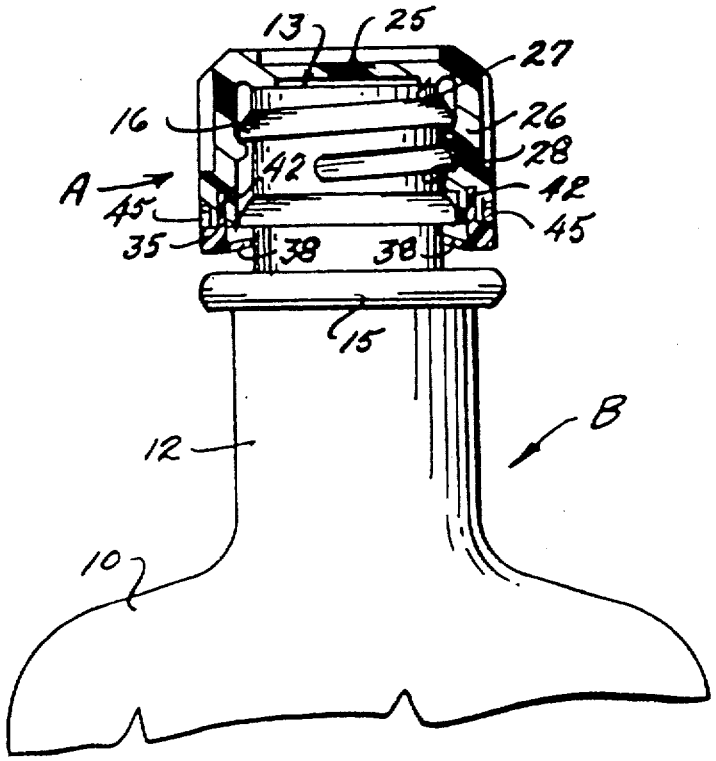

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 14, 22 and 40 are cancelled.

Claims 2, 5, 8, 15, 16, 18, 21, 23, 24, 28, 29 and 41 are determined to be patentable as amended.

Claims 3, 4, 6, 7, 9–13, 17, 19, 20, 25–27, 30–39 and 42 dependent on an amended claim, are determined to be patentable.

2. [A tamper evident closure as specified in claim 1 wherein] *A tamper evident closure for use on a container having a neck provided with a mouth, cap retaining means and including a shoulder disposed below the cap retaining means thereof, said closure comprising:*

*a cap;*

*a security ring formed disjunctively from said cap; and*

*fused bridge means for interconnecting said security ring to said cap,*

*said cap including retaining means adapted to cooperate with the cap retaining means of the container neck thereby to retain said cap on the container neck as juxtaposed for closing the mouth thereof, and including* [said cap includes] a depending cylindrical skirt having a lower edge portion. [and]

*said security ring including anchor means disposed to pass over and catch beneath the shoulder of the container when said cap is juxtaposed on the container neck for closing the mouth thereof,*

*said fused bridge means comprising frangible zones of weakness adapted to rupture during removal of said cap from said container neck whereby to enable said security ring to break away from said cap,*

*said anchor means being engageable with the shoulder of the container neck for retaining said security ring on the container neck when said cap is removed therefrom,* said security ring [has] *further having* an upper edge portion, each said edge portion having guide means inset from the outer periphery thereof, one said guide means comprising female guide means, and the other said guide means comprising male guide means disposed to mate within said female guide means, that part of each said edge portion as inset from the periphery to said guide means thereof comprising a land surface, the land surface of one said edge portion including a plurality of spaced apart protuberances extending therefrom and having a top juxtaposed to abut against the land surface of the other said edge portion, the tops of said protuberances extending from the land surface of one said edge portion being fused to the land surface of the other said edge portion against which the same abut and thereby comprising said fused bridge means.

5. A tamper evident closure as specified in either of claims [1,] 2, 3, or 4, and wherein said cap is of one color and said security ring is of another color.

8. A tamper evident closure as specified in either of claims [1,] 2, 3, or 4, and wherein said cap is molded from a given material and said security ring is molded from another material.

15. [A tamper evident closure as specified in claim 14 wherein] *A tamper evident closure for use on a container neck provided with a mouth and retaining means and having a shoulder disposed below the retaining means thereof,* the retaining means of said container neck comprises an external screw thread portion, *said closure comprising:*

*a molded cap;*

*a security device formed independently of and separate from said cap; and*

*connector means for attachment of said security device to said cap, said cap including retaining means adapted to cooperate with the retaining means of the container neck whereby to retain said cap on the container neck as juxtaposed for closing the mouth thereof,* [and] retaining means of said cap [comprises] *comprising* an internal screw thread portion adapted to mate with the external screw thread portion of the container neck,

*said security device having a body portion extending circumferentially about said container neck and including anchor means disposed to catch beneath the shoulder of the container neck when said cap is juxtaposed on the container neck for closing the mouth thereof,* said security device [comprises] *further comprising* an annular band for encircling the neck of the container,

*said connector means comprising frangible joint means adapted to rupture during removal of said cap from said container neck whereby to enable said security device to break away from said cap,*

[and] said anchor means [comprises] *comprising* a plurality of spaced apart fingers disposed to pass over and catch beneath the shoulder of the container, *said anchor means being engageable with the shoulder of the container neck for retaining said security device on the container neck when said cap is removed therefrom* and

[wherein] said cap [includes] *further including* a cylindrical skirt portion having a substantially cylindrical groove extending about the lower edge thereof and said annular band [includes] *including* a substantially cylindrical tongue extending about the upper edge thereof, [hereby] *whereby* to provide a tongue and groove fit between said cap and said annular ring in juxtaposed relation to prevent side shear of said cap from said annular ring during the hoppering and sorting phase of the operation during which the closure is applied to the container.

16. A tamper evident closure as specified in claim 15 and wherein said connector means comprises a plurality of spaced apart bridge means extending upwardly from said annular ring and circumferentially of said tongue thereof and including a tapered tip, each said tapered [tips] *tip* being fused to the lower edge of said skirt of said cap and circumferentially of said groove thereof.

18. A tamper evident closure as specified in either of claims [14,] 15, 16, or 17, and wherein said cap is molded of one material and said security device is molded of another material.

21. A tamper evident closure as specified in either of claims [14,] 15, 16, or 17, and wherein said cap is molded of material of one color and said security device is molded of material of another color.

23. [A method of manufacturing a tamper evident closure as specified in claim 22 and which is for use on a] *A method of manufacturing a tamper evident closure for use on a container neck provided with a mouth and having a shoulder disposed below the mouth thereof, the* container neck having an external screw thread portion and the shoulder of the container neck [is] *being* disposed below the screw thread portion thereof, *and wherein the tamper evident closure includes a cap configured to serve as a closure for the mouth of the container and a security device detachably interconnected thereto, the security device being provided with anchor means adapted to catch beneath the shoulder of the container neck for retaining the security device on the container neck when the cap is loosened and removed from the container neck, the method comprising the steps of:* [and wherein]

*molding the cap,* the cap [is] *being* molded with a depending skirt portion *having a lower edge portion and* having an internal screw thread portion for mating with the external screw thread portion of the container neck, and

*molding the security device independently of and separate from the cap,* the security device [is] *being* molded as an annular ring for extending about the container neck and is provided with a plurality of spaced apart fingers which comprises the anchor means thereof, the skirt portion of the cap *having an upper edge portion*

*each said edge portion having guide means inset from the outer periphery thereof, one said guide means comprising female guide means, and the other said guide means comprising male guide means disposed to mate with said female guide means in juxtareltion to minimize side shear and separation of said security ring from said cap during assembly of one to the other, said female guide means comprises a substantially cylindrical groove and said male guide means comprises a substantially cylindrical tongue,* [is molded with a groove extending about the lower edge portion thereof and the security device is molded with a tongue extending upwardly from the upper edge thereof in juxtaposition for a tongue and groove fit within the groove of the skirt of the cap,]; and

*interconnecting the cap and security device by connector means adapted to rupture during removal of the cap from the container neck whereby to enable the security device to break away from the cap and remain on the container neck when the cap is removed therefrom* wherein the assemblage of a cap to an annular ring includes the steps of mating one to the other by a tongue and groove fit as provided by insertion of the tongue [of the annular ring] to within the groove [of the skirt of the cap] and thence interconnecting the cap to the skirt by the connector means.

24. A method of manufacture as specified in [either of claims 22, or 23,] *claim 23* and wherein the cap is molded of one material and the security device is molded of another material.

28. A method of manufacture as specified in [either of claims 22, or 23,] *claim 23* and wherein the cap is molded of material of one color and the security device is molded of material of another color.

29. A method of manufacture as specified in [either of claims 22, or 23,] *claim 23* and wherein the cap and the security device are molded of thermoplastic material and the connector means are comprised of a plurality of spaced apart bridges which are molded as a part of the security device and are fused to the cap.

41. [A tamper evident closure as specified in claim 40 and herein] *A tamper evident closure for use on a container having a neck provided with a mouth, cap retaining means and including a shoulder disposed below the cap retaining means thereof, said closure comprising:*

*a cap;*

*a security ring formed disjunctively from said cap; and*

*means for interconnecting said security ring to said cap, said cap including retaining means adapted to cooperate with the cap retaining means of the container neck thereby to retain said cap on the container neck as juxtaposed for closing the mouth thereof and a depending cylindrical skirt having a lower edge portion,*

*said security ring including anchor means disposed to pass over and catch beneath the shoulder of the container when said cap is juxtaposed on the container neck for closing the mouth thereof and an upper edge portion,*

*each said edge portion having guide means inset from the outer periphery thereof, one said guide means comprising female guide means, and the other said guide means comprising male guide means disposed to mate with said female guide means in juxtarelation to minimize side shear and separation of said security ring from said cap during assembly of one to the other,* said female guide means comprises a substantially cylindrical groove and said male guide means comprises a substantially cylindrical tongue,

*said means for interconnecting said security ring to said cap comprising zones of weakness adapted to rupture during removal of said cap from said container neck, said anchor means being engageable with the shoulder of the container neck for retaining said security ring on the container neck when said cap is removed therefrom.*

* * * * *